United States Patent [19]

Nelson et al.

[11] Patent Number: 4,943,447

[45] Date of Patent: Jul. 24, 1990

[54] AUTOMOTIVE COATING TREATING PROCESS

[75] Inventors: James S. Nelson, Moundsview; Scott L. Angell, New Hope; Jack E. Mannerud, Plymouth; Charles H. Bergman, Jr., New Brighton, all of Minn.

[73] Assignee: BGK Finishing Systems, Inc., Blaine, Minn.

[21] Appl. No.: 403,654

[22] Filed: Sep. 6, 1989

Related U.S. Application Data

[62] Division of Ser. No. 151,912, Feb. 3, 1988, Pat. No. 4,908,231, which is a division of Ser. No. 905,289, Sep. 19, 1986, Pat. No. 4,771,728.

[51] Int. Cl.[5] ..... B05D 3/06; B05D 1/36; B05D 3/02; F26B 3/28

[52] U.S. Cl. ..... 427/55; 427/13; 427/379; 427/409; 34/4

[58] Field of Search ..... 427/55, 379, 388.1, 427/13, 33, 409; 118/642, 643; 34/4, 39, 68

[56] References Cited

U.S. PATENT DOCUMENTS

| | | | |
|---|---|---|---|
| 1,998,615 | 4/1935 | Groven | 427/55 |
| 3,151,950 | 10/1964 | Newman et al. | 427/55 |
| 4,009,364 | 2/1977 | Ladstädter | 427/55 |
| 4,336,279 | 6/1982 | Metzger | 427/55 |
| 4,341,821 | 7/1982 | Toda et al. | 427/409 |
| 4,594,266 | 6/1986 | Lemaire et al. | 427/55 |
| 4,892,750 | 1/1990 | Soshi et al. | 427/33 |

*Primary Examiner*—Norman Morgenstern
*Assistant Examiner*—Marianne L. Padget
*Attorney, Agent, or Firm*—Merchant, Gould, Smith, Edell, Welter & Schmidt

[57] ABSTRACT

A process for heat treating a coating applied to an automobile body is disclosed. The process is carried out with apparatus which includes radiant heating elements for generating radiant heat in a predetermined path and convection heating elements for generating the flow of heated air. The method comprises the steps of positioning a freshly coated automobile body within the apparatus and heating the body with the radiant heat for a time sufficient to set the coating on Class A surfaces of the body. After the Class A surfaces are set, heated air is flowed around the body to heat the body and cure the coating on the Class A surfaces and the non-Class A surfaces.

7 Claims, 7 Drawing Sheets

AUTOMOTIVE COATING TREATING PROCESS

This is a divisional application of U.S. Ser. No. 151,912filed on Feb. 3, 1988 (now U.S. Pat. No. 4,908,231) which is a division of U.S. Ser. No. 905,289, filed Sept. 8, 1986 (now U.S. Pat. No. 4,771,728).

BACKGROUND OF THE INVENTION

I. Field of the Invention

This invention pertains to a process for heat treating a coating applied to an automobile body and, more particularly, to setting, drying and/or curing a fresh coating (such as paint or the like) applied to a newly completed automobile body.

II. Description of the Prior Art

During the manufacture of an automobile, it is desirable to provide a finished vehicle body having a high quality finish. The high quality of the finish improves the marketability of the vehicle as well as protects the vehicle body from the elements. In the automobile industry, it is recognized that not all surfaces of the automobile body need have the same quality of finish. For example, those surfaces of the automobile body which are not readily visible to the vehicle user do not require a high gloss finish but may only require a finish sufficiently good to protect the vehicle's surface from the elements. Recognizing the intricacies of an automobile body and the various requirements for the finished coat at different locations on the automobile body, the industry has developed certain nomenclature and standards which are used when referring to the finished coat of an automobile. For example, the industry has employed the phrase "Class A surfaces" which refers to those surfaces of the automobile body which are readily visible to an individual inspecting the automobile under normal conditions. These surfaces include the outer door panels, the fenders, the exterior hood, the exterior trunk and the top of the vehicle. Excluded from Class A surfaces are such surfaces of the automobile which are not seen during normal inspection of the vehicle. Such surfaces will include the inner walls of the door posts and side walls of door panels.

In addition to segregating the various surfaces of an automobile into identifiable classifications, the industry has established (in addition to other methods) a scale referred to as the "Tension scale" to provide for means of characterizing the quality of a finish on a given surface. The Tension scale is a measurement of the reflectivity of the surface. A very high quality and reflective surface will have a high scale number. The scale has a range of 0 to 20 with 20 being a mirror quality surface. In the industry it is recognized to be beneficial to maximize the Tension scale rating of Class A surfaces while insuring that non-Class A surfaces have a sufficient covering to protect the non-Class A surfaces from the elements.

In the prior art of providing finishes for automobile bodies in an automobile assembly plant, the automobile bodies would be intensely cleaned prior to receiving several coats of finish. A common first coat for an automobile body was an electro-deposition of a coating. This coat was commonly referred to as a "E-dip" or "E-coat". The E-coat normally took place in an apparatus where the automobile body was either charged or grounded and the coating to be applied was charged oppositely of that of the body.

Following the application of the E-coat, the automobile body would receive a second coat referred to as the "base coat" or "color coat". Historically, the color coat was a solvent based coating. After the color coat was applied, the automobile body was taken to a flash-off area where the color coat was allowed to set momentarily. After the color coat had partially set, the vehicle was then subjected to a clear coat which was often applied while the color coat was still wet. With the color coat and clear coat applied, the automobile body was admitted to an oven for a period of time to initially set the clear coat. This would commonly last about eight minutes. After leaving the oven, the vehicle was admitted to a hot air convection oven for a more extended period of time to cure the clear and color coats. Not uncommonly, the more extended period of time would last approximately 35 minutes.

With common assembly line speeds of 15 to 28 feet per minute, the area in an assembly plant devoted to setting and curing the automobile finish could be immense. For example, assuming an assembly line speed of 35 feet per minute and an oven time of 40 minutes, 1,200 feet of assembly line would be required to dry and cure the automobile body finish.

In addition to the amount of assembly line which would be devoted to finishing the auto body, the prior techniques of auto body finishing presented certain environmental and occupational hazards. For instance, the solvent based coatings would generate noxious vapors which presented concerns to both the safety of the workers and the environment. As a result of these potential problems, an interest has developed in using water based coatings as the color coat. However, simply substituting a water based color coat for a solvent based color coat complicates the finishing process because water based paints are typically slower to dry than the solvent based paints. Also, the application of a clear coat on top of a water based color coat is likely to lead to complications in the finishing process. Such complications include bubbling, cracking or "popping" of the finish as the water vapor of the color coat attempts to pass through the clear coat. This will occur when the water vapor of the color coat is not completely dried prior to application of the clear coat. This problem typically did not occur with the use of solvent based color coats since the solvents from the color coat are compatible with the clear coat and can pass through the clear coat.

From the foregoing, it will be appreciated there is an on-going need to reduce the amount of time necessary to effectively cure coats on an automobile body. This need is particularly acute in applications using water based color coats. The reduction in the amount of necessary time also results in a reduction of assembly line space which must be devoted to the finishing process. While reduction in the amount of necessary time to effect the finishing operation is an industry goal, this effort is constrained by the requirement of adequately coating the automobile body to protect its surfaces from the elements and to provide Class A surfaces having as high a quality of finish as possible.

OBJECTS AND SUMMARY OF THE PRESENT INVENTION

It is an object of the present invention to provide an apparatus for heat treating a finish applied to an automobile body.

A further object of the present invention is to provide an apparatus and method for heat treating the finish of an automobile body in a reduced amount of time while maintaining a higher quality of finish on Class A surfaces.

According to a preferred embodiment of the present invention, a method and apparatus is provided for heat treating a coating (such as paint, acrylics or the like) applied to an automobile body. The method and apparatus includes a source of radiant heat which is initially directed at a freshly coated automobile body to set the coating on the Class A surfaces of the auto. With the Class A surface coating set, a flow of hot air is impinged upon the automobile to set the coating on surfaces of the automobile body which have been shadowed from the radiant heat source and to cure the coated surfaces. In one embodiment of the invention, the setting and curing take place in a chamber having a baffle wall surrounding the auto body and an outer wall spaced from the baffle wall to define a plenum chamber. Openings or passages through the baffle wall permit air to flow from the plenum chamber toward the automobile body. A panel of infrared lamps are disposed on the baffle wall facing the auto having nozzles for receiving air flow from the baffle wall passage and directing the air flow to cool the lamps as the air flows to the automobile.

DESCRIPTION OF THE PREFERRED EMBODIMENT

A. Apparatus of a First Preferred Embodiment.

Figure 1:
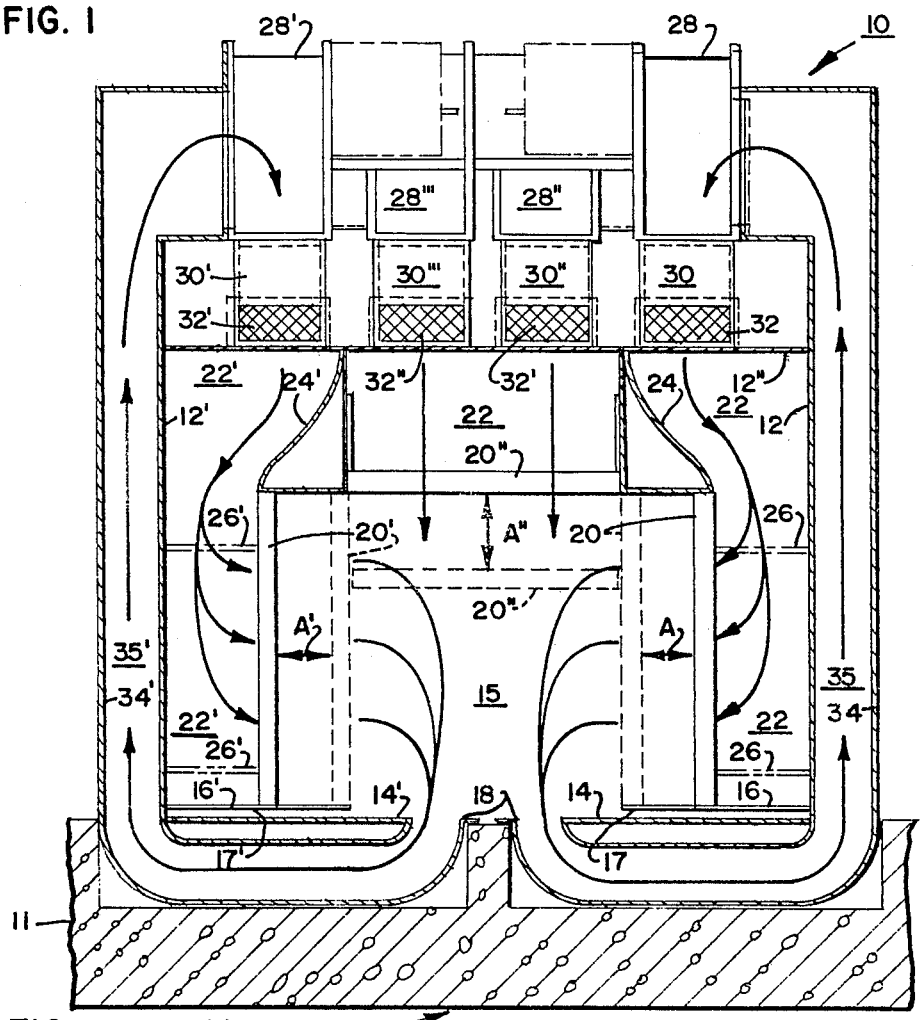
FIG. 1 is an end section view taken in elevation of an automotive heat treatment apparatus according to the present invention.
Figure 2:
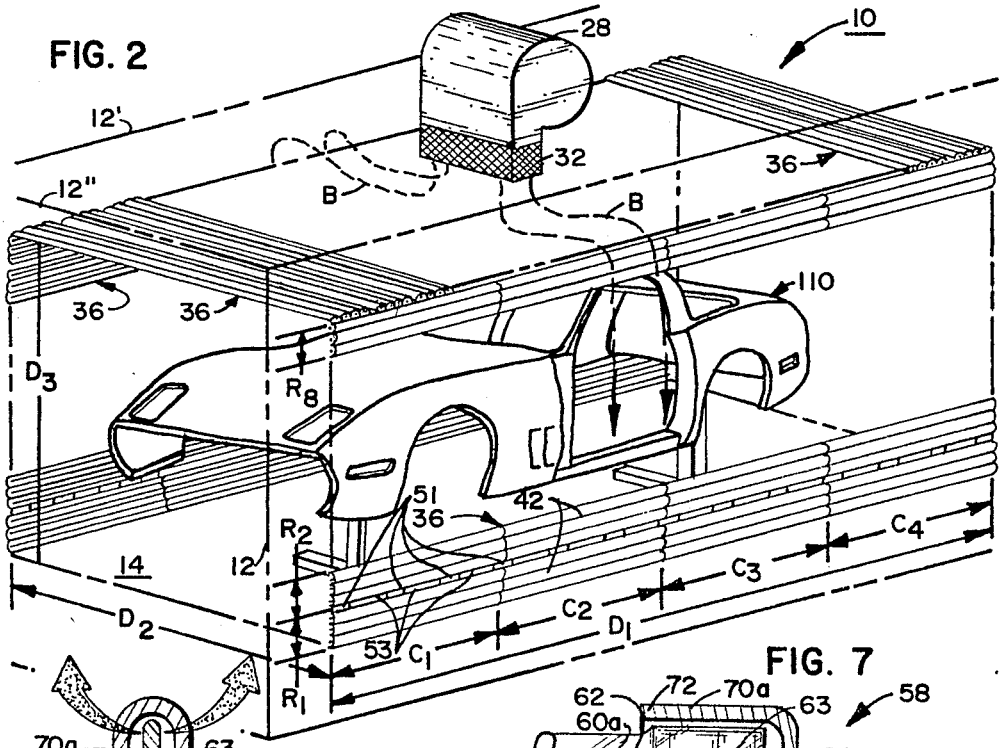
FIG. 2 is a perspective view of an automotive heat treatment apparatus according to the present invention showing infrared heating panels surrounding an automotive body to be cured.

Referring now to FIGS. 1 and 2, an apparatus is shown for batch treating automobiles having newly applied coatings such as paint, acrylic or the like. The term "batch treating" will be used to refer to a process by which an automobile body having a newly applied coating is admitted to a single apparatus and the coating is completely treated within the apparatus. After the coating is treated, the body is removed from the apparatus and a new automotive body with a freshly applied coating is placed in the apparatus for treatment. This type of processing will be distinguished from continual processing, where the automotive body is in continuous movement along an assembly line during the finishing process.

In the automobile industry, heat treatment of the automotive coating may take place in either a batch process or an assembly line process. Both have peculiar advantages and disadvantages. It is intended the present invention will extend to both batch and assembly line processes. While the apparatus and method of the invention will first be described with reference to a batch process, it will be appreciated this is done for convenience only and is not intended to limit the scope of the present invention to a batch process.

In FIG. 1, an automotive coating heat treatment apparatus 10 is disposed resting on a foundation 11 and includes a first outer wall 12 and 12′ which extend along opposite sides of the apparatus 10. A roof wall 12″ joins side walls 12 and 12′. A floor 14 connects the bottom edges of walls 12 and 12″. Intermittently disposed along floor 14 are a plurality of openings 18 extending through floor 14 and connected to duct work as will be described. Horizontal aligned slide support floors 16, 16′ extend inwardly from each of side walls 12, 12′, respectively, and terminate in spaced relation. Slide support floors 16, 16′ are disposed above floor 14 and spaced therefrom to define a floor air passage 17.

Left and right baffle walls 20 and 20′ are disposed within the volume defined between outer walls 12 and 12′. Baffle walls 20 and 20′ are maintained in spaced relation from outer walls 12 and 12′, respectively, with side walls 12 and 12′ and baffle walls 20 and 20′ cooperating to define a pair of side plenum chambers 22 and 22′.

Headers 24 and 24′ are secured to roof 12″ with baffle walls 20 and 20′ extending between slide support floors 16, 16′ and headers 24, 24′. Means 26 and 26′ are provided for slidably moving baffle walls 20 and 20′ a predetermined stroke in a direction indicated by the arrows A and A′, respectively. The means 26 and 26′ can be any well known adjusting device and preferably include recirculating ball nut and ball mechanism which includes a ball screw rotatably received in baffle walls 20 and 20′ and extending through a ball nut in walls 12 and 12′. By turning the ball screw rod, the nut advances in a desired direction. The nut is secured to walls 12 and 12′ with plenum walls 20 and 20′ moving in the desired direction along the paths indicated by arrows A, A′. An upper baffle roof 20″ is provided lying in a generally horizontal plane extending between headers 24 and 24′. Baffle wall 20″ and roof 12″ define upper plenum chamber 22″. Baffle wall 20″ is movable by means such as means 26″ in the direction of arrow A″ between the position shown in solid lines and that shown in phantom lines. The movability of baffle walls 20, 20′, 20″ as described is shown in the preferred embodiment. However, as the method of the invention will make clear to those skilled in the art, having movable baffle walls is not necessary to practicing the invention and only provide means for maximizing radiant energy in an auto body, as will be described, by placing heat producing lamps as near as possible to the auto body. The opposing baffle walls 20, 20′, 20″ define an interior chamber 15 of the apparatus 10.

Disposed above roof 12″ are a plurality of blowers, four of which are shown at 28, 28′, 28″ and 28‴. Blowers 28 through 28''' are conventional items and are preferably provided with axial inlets and radial outlets. Motors (not shown) are provided for driving the blowers. The radial outlet of blower 28 is connected via a duct 30 to plenum chamber 22. Within duct 30, a heater element 32 is provided for heating air passing from blower 28 into chamber 22. Likewise, blower 28' is provided with a duct 30' connecting the outlet of blower 28' with plenum 22'. A heater 32' is provided within duct 30'. Similarly, blowers 28'' and 28''' are in communication with plenum chamber 22'' via ducts 30'' and 30''', respectively Heaters 32'' and 32''' are provided within ducts 30'' and 30'''.

As shown in FIG. 1, the apparatus 10 rests on a foundation 11 and duct work 34 connects openings 18 with the axial air inlets of blowers 28 through 28'''. The apparatus 10 has been generally described with respect to movable baffles and air plenums in communication with blowers as well as duct work for recirculating air flow. FIG. 1 is shown in front elevational view showing side walls and a roof element. In addition to side baffle walls and a roof baffle, the apparatus 10 also includes a front and back wall (not shown) which will also consist of outer walls and spaced apart baffles such as those described with reference to side walls 12 and side baffles 20.

FIG. 2 shows the apparatus of FIG. 1 in perspective format with the duct work 34 not shown and with side walls 12, 12' and roof 12'' shown in phantom lines. Additionally, the baffle walls 20 through 20'' are not shown but, instead, panels 36 of infrared lamps are shown which are intended to be connected to the baffle walls as will be described. Also shown in FIG. 2, for simplicity of illustration a single blower 28 is shown providing air to both side plenums 22 and 22'.

Figure 3:
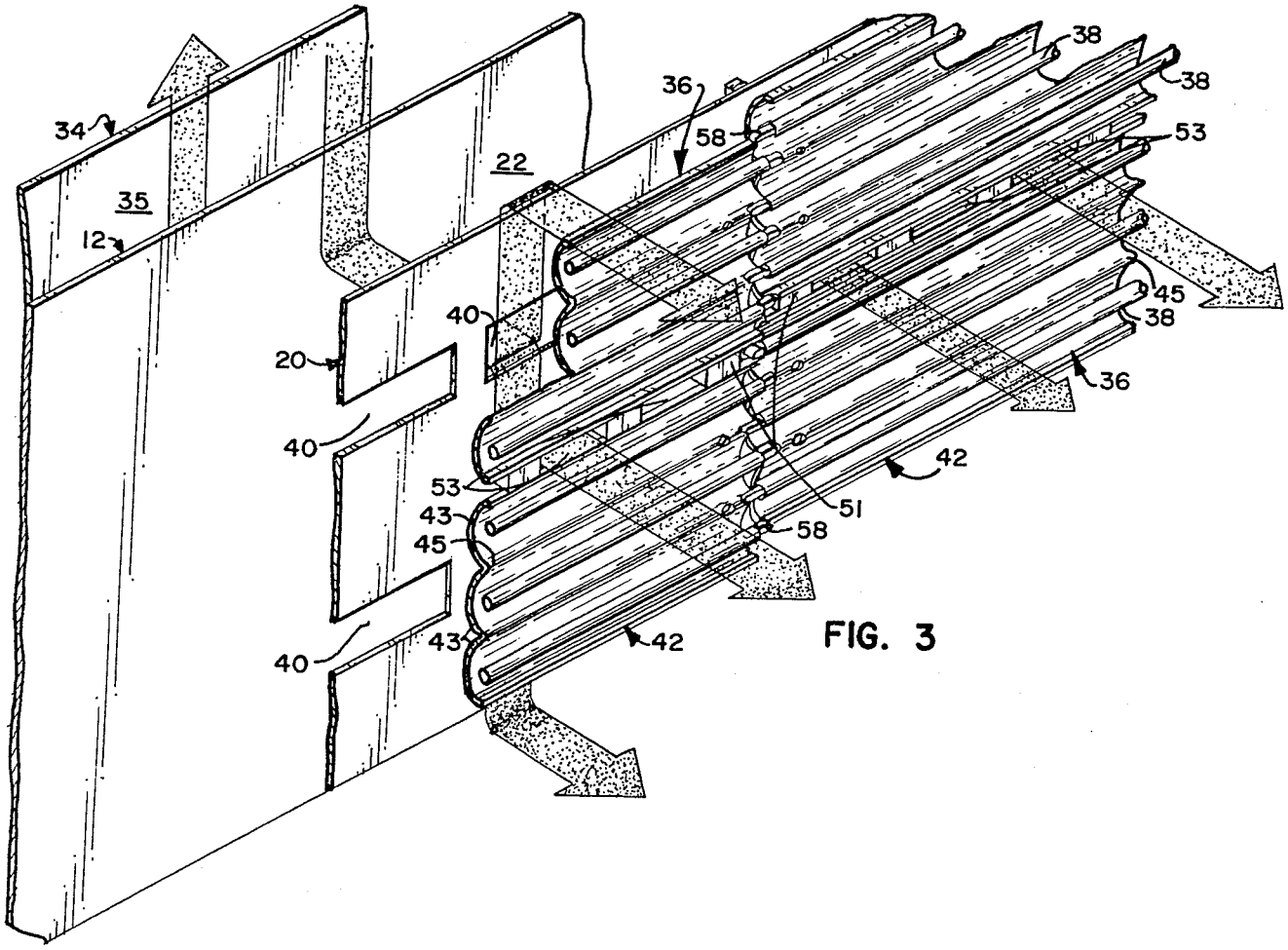
FIG. 3 is a perspective view showing a portion of a wall unit of the apparatus of FIG. 1.

The specific structure of the baffle wall 20 and return duct 34 is best shown with reference to FIG. 3. It will be appreciated the structure of walls 12 through 12'', baffle walls 20 through 20'', the ducts 34, plenums 22 through 22'' and the structure of front and back walls (not shown) are all similar and a description of wall 12, baffle wall 20 and associated lamp panel 36 will suffice as a description of all.

In FIG. 3, baffle wall 20 is shown in spaced relation from side wall 12 to define plenum chamber 22 therebetween. Duct 34 is also spaced from side wall 12 defining the air return chamber 35. In FIG. 3, the panel 36 of heat producing infrared lamps is positioned secured to baffle wall 20 for movement therewith. Panel 36 comprises a plurality of high intensity infrared lamps 38. A preferred lamp is a quartz envelope lamp having a tungsten filament. Such lamps are commercially available and include lamps designated T-3 and available from numerous source such as The Westinghouse Corporation. Such lamps preferably have an emission rate of between 30 and 150 watts per square inch at the light source.

Figure 4:
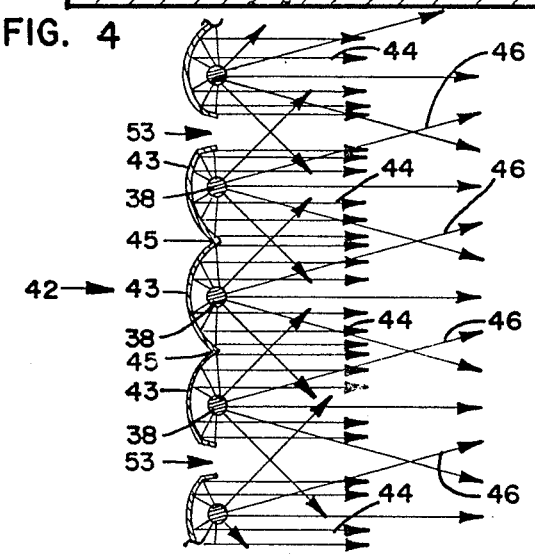
FIG. 4 is an end elevation view of infrared heating elements for use in the present invention.

Shown in FIGS. 3 and 4, each of the lamps 38 is disposed within a trough shaped member 43. As shown in FIG. 4, the lamps come in banks 42 of three parallel connected troughs 43 each housing an individual lamp 38. The troughs 43 are connected at parallel spaced apart ridges 45. Preferably, the troughs 43 are, in cross-section, a parabola with the lamp 38 positioned at the focus of the parabola. The trough surface facing the lamp 38 is provided with a specular high polish reflective finish. With the lamp 38 so positioned, light which is directed from the lamps to the parabola surface of the trough 43 is projected away from the trough 43 in parallel alignment as shown by light rays 44. The parallel rays 44 together with the randomly scattered rays 46 which do not impact the trough 43 project toward the interior chamber 15 of apparatus 10. As shown in FIG. 3, the various banks 42 of lamps are organized such that all of the lamps are parallel to one another and will provide uniform illumination as will be described.

Figure 5:
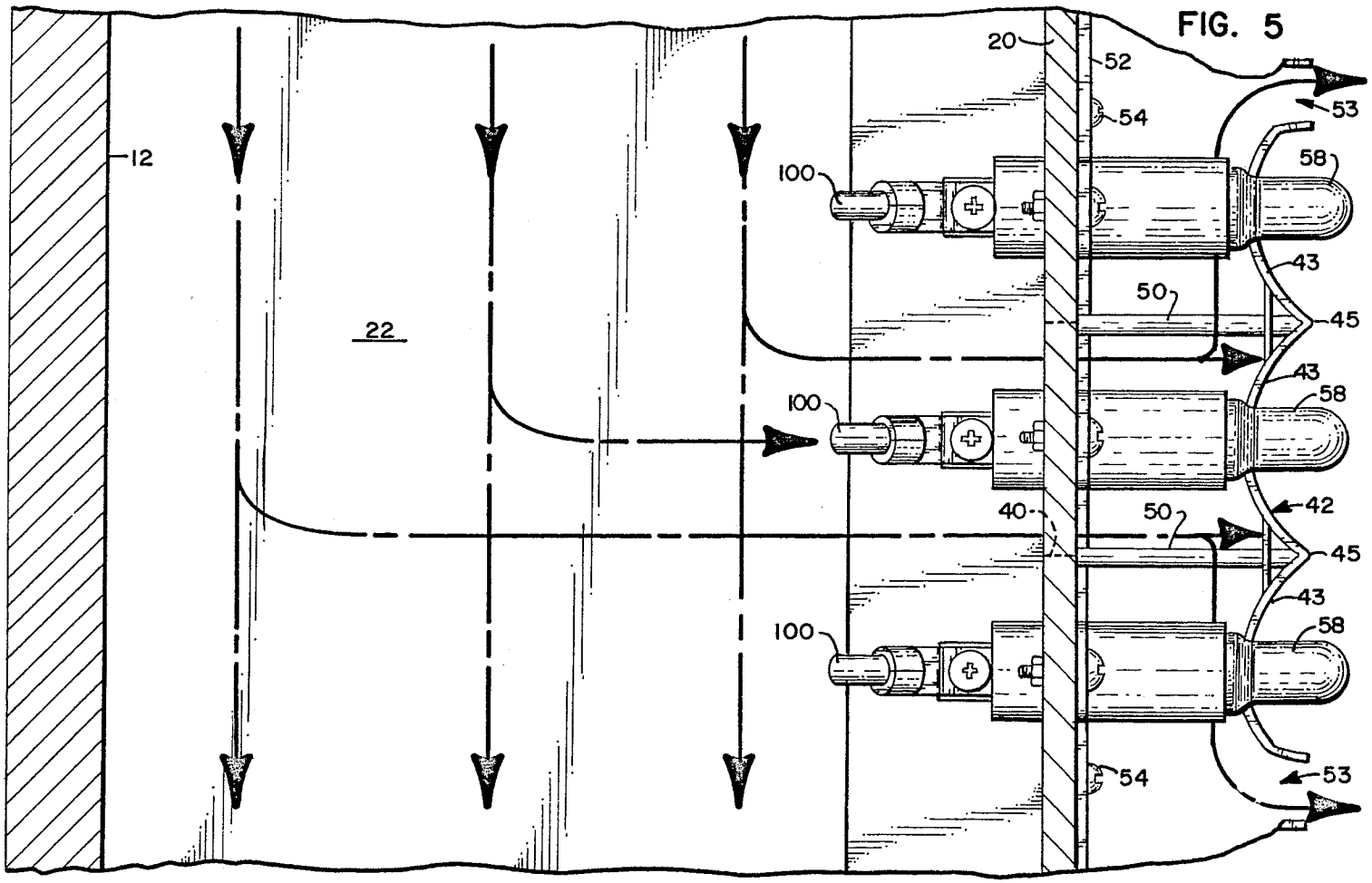
FIG. 5 is a section view taken in elevation of the apparatus of FIG. 1.

As shown in FIG. 3, the baffle wall 20 is provided with a plurality of air passages 40 formed therethrough in communication with chamber 22. The reflector plates or troughs 43 are secured to the baffle wall by means of support brackets 50 extending between the reflector plates and a mounting plate 52 (shown in FIG. 5). Mounting plate 52 is secured to baffle plate 20 by means of a plurality of bolts 54. Shown best in FIGS. 3 and 5, lamp banks 42 are disposed on baffle wall 20 with parallel adjacent banks 42 being in parallel spaced apart alignment. Spaced apart deflection plates 51 extend between opposing banks 42 to define a plurality of spaced apart nozzles 53 between opposing surfaces of spaced apart banks 42. Banks 42, nozzles 53 and baffle passages 40 are mutually positioned such that the axis of nozzles 53 are not in alignment with the axis of baffle passages 41.

Figure 6:
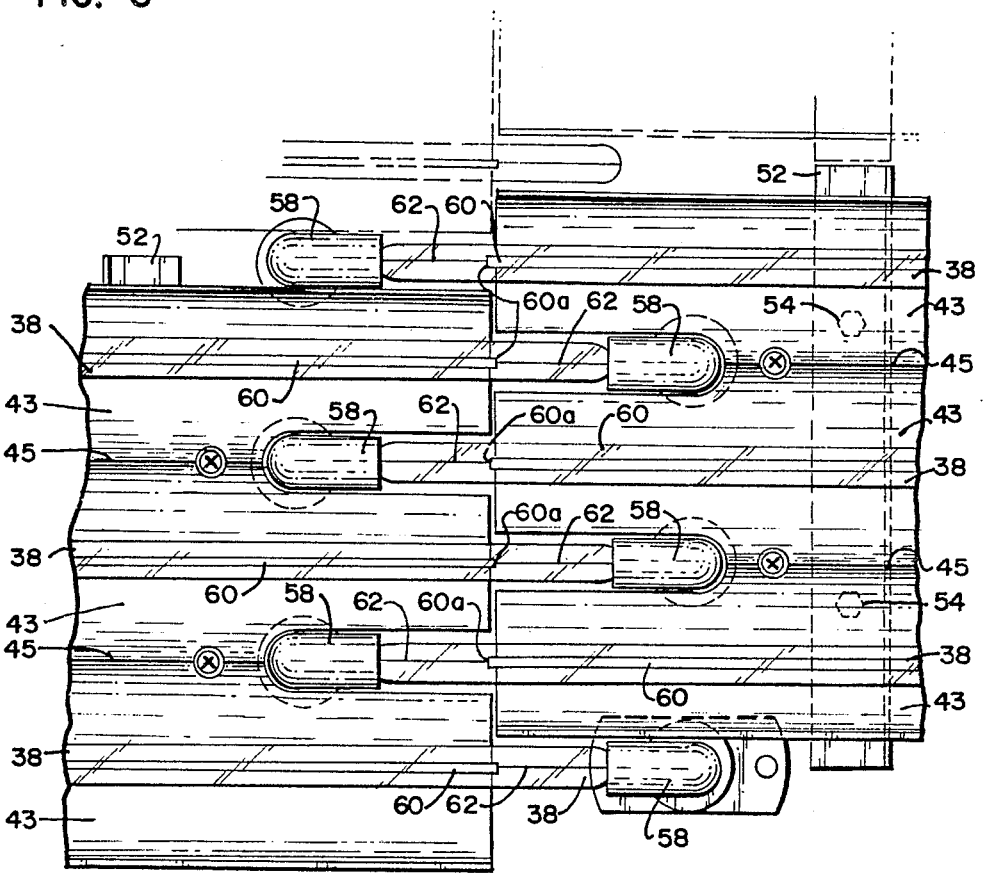
FIG. 6 is a plan view of the radiant heating elements of the present invention.

Adjacent banks 42 of lamps 38 are positioned such that the troughs 43 of a bank 42 abut the ridges 45 of an adjacent bank 42. Best shown in FIG. 6, the ridges 45 of the reflectors are provided with linearly extending slots 54 sized to receive a lamp mount 58. Each of the lamps 38 has a filament 60 which terminates at an end 60*a* spaced from mounts 58. An electrode 62 extends from the end 60*a* of the filament 60 into the mount 58 to provide electrical connection as will be described. The lengths of slots 54 are sized to approximate the distance from the filament 60*a* to the rear end of mounts 58. Accordingly, when the banks 42 of lamps 38 are installed as shown in FIG. 6, the ends 60*a* of adjacent filaments 60 are in linear alignment. Accordingly, there is no overlap of filament 60 from one bank to another nor is there any gap between filament ends of adjacent banks. Therefore, when the lamps 38 are illuminated, there is uniform illumination throughout the panel 36.

Figure 9:
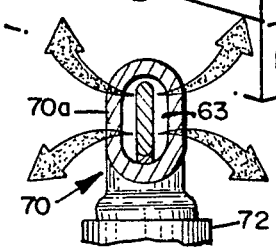
FIG. 9 is a view taken along line IX—IX of FIG. 8.
Figure 8:
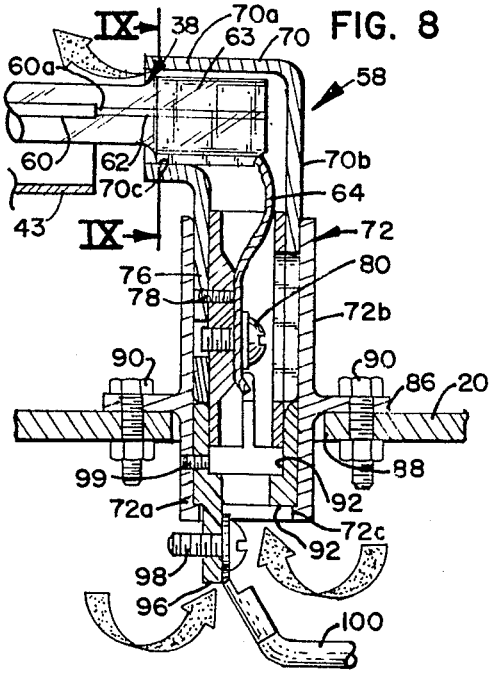
FIG. 8 is an assembled view of the heating element mount of FIG. 7.
Figure 7:
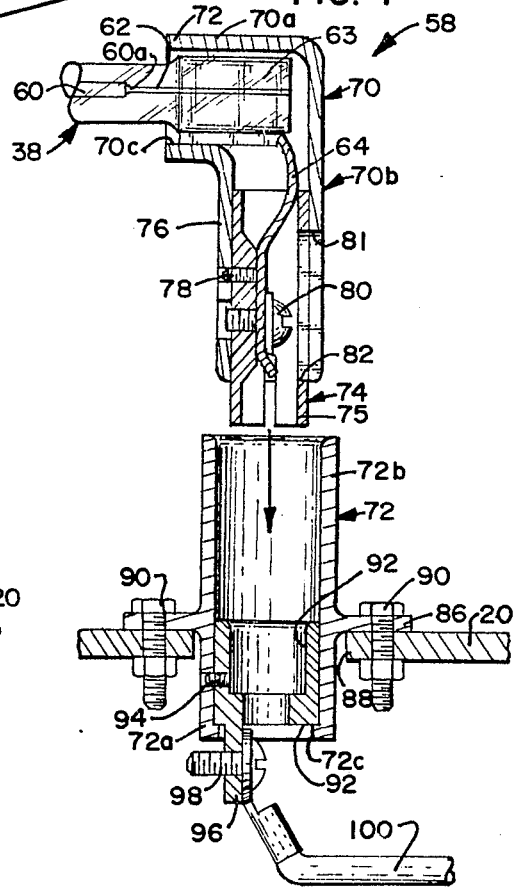
FIG. 7 is a dissembled view of a heating element mount of the present invention.

Lamps 38 are secured to baffle wall 20 by a novel mount 58 shown most clearly in FIGS. 7–9. Mount 58 includes a male ceramic member 70 and a female ceramic member 72. Mount 58 is adapted to receive a lamp 38 such as a T-3lamp which includes a quartz envelop containing a tungsten filament 60 terminating at an end 60*a* with an electrode 62 extending from 60*a* and terminating at a flattened electrode portion 63 having a terminating wire 64. Shown most clearly in FIG. 7, male ceramic member 70 is elbow shaped in configuration and is hollow A first end 70*a* is sized to slidably receive flattened electrode 63 in spaced relation from opposing side walls of member 70. An insertable electrically conductive metal sleeve 74 is sized to be slidably received within a second end 70*b* of ceramic member 70. Insert 74 is connected to end 70*b* by means of a set screw 78 received through axially aligned openings of end 70*b* and insert 74. Insert 74 and end 70*b* also include a second set of axially aligned openings sized to receive the threaded portion of a screw 80 which is threadedly engaged within the opening through the insert 74. An axially extending slot 82 formed on insert 74 on a side thereof opposite the second set of openings is aligned with a slot 81 on end 70*b*. The slots 82 and 81 are sized to receive a screw driver permitting an operator to insert the screw driver to turn screw 80. With flattened portion 63 inserted first within second end 70*a*, electrical connector 64 is connected to metallic insert 74 in electrical and mechanical connection by means of screw 80 as shown in FIG. 7. With insert 74 secured to second end 70*a* by set screw 78, a free end 75 of insert 74 extends freely away from second end 70*b*.

Female member 72 of connector 58 is a hollow cylindrical member having a generally centrally positioned radial flange 86. Baffle wall 20 is provided with an opening 88 sized to receive a first end 72*a* of member 72 with flange 86 secured to baffle wall 20 by means of nut and bolts 90. The second end 72*b* of member 72 extends away from baffle 20 and has an inside diameter sized to snuggly receive an outside diameter of portion 70*b* of member 70. A cylindrical metallic insert 92 is received within first end 72*a* and secured therein by a set screw 94. Insert 92 is hollow and has an inside diameter sized to snuggly receive the outside diameter of insert 74 of male member 70 (as shown in FIG. 8) to provide sound electrical and mechanical connection between insert 74 and insert 92. A tab 96 extends from insert 92 and is provided with a threaded screw 98 for receiving and retaining an electrical conductor 100. As shown, insert 92, member 72, member 70 and insert 74 are all hollow to provide for air flow communication between opening 70*c* of male member 70 and opening 72*c* of female member 72.

With the structure of the apparatus 10 being generally described and with the structure of the baffle 20, plenums 22, lamps 38 and their mounts 58 being described in particular detail, attention is now directed to FIG. 2 where the apparatus will be described for use in heat treating a coating applied to an automobile body 110. In FIG. 2, outer side walls 12 and 12' are shown in phantom lines as is roof 12". Baffle walls are not shown. Instead, panels 36 of lamps 38 are shown on the sides and top of the chamber 15. These panels 36 of lamps would be connected to plenum walls 20, 20' and 20", respectively as previously described. In the view of FIG. 2, end walls are not shown for the purpose of illustration. Also, in the view of FIG. 2, a single blower 28 having a heater 32 is shown for supplying a flow of air indicated by the arrows B to both sides of the chamber 15.

As shown in FIG. 2, the side wall panels 36 of lamps 38 have longitudinal lengths sized to completely extend the length of an automobile. A preferred length indicated by the distance $D_1$ would be 16 feet. A preferred maximum width indicated by the distance $D_2$ of the end walls would be 11½ feet and a preferred distance $D_3$ of the maximum height of the side walls would be 6½ feet. In a preferred embodiment each of the side walls of lamp panels would be segmented into a plurality of zones. For example, in a preferred embodiment, the dimension $D_1$ would be segregated into four different vertical columns, $C_1$–$C_4$, with the length of each of the columns equalling the length of a single bank 42 of lamps 38. Each column, $C_1$–$C_4$, would be divided into eight rows, $R_1$–$R_8$, each now having a height equal to the height of one bank 42 of three lamps 38 per bank 42. As a result, on each side wall, there will be 32 individual zones of lamps which can be independently illuminated. By independently illuminated, it is meant the lamps within a zone can be selectively turned off and one and their intensity may be selectively varied. Likewise, the panel 42 of lamps 38 on the roof of the chamber would include four separate zones of eight foot lamps extending the entire width of the roof. Each of these four separate zones could be independently and proportionately illuminated. Finally, similar zones could be applied on the end doors (not shown) of the apparatus. Through any suitable control device (not shown) such as a microprocessor or the like, any combination of individual zones can be independently illuminated (from 0 to 100% intensity) as desired.

In addition to separating the plurality of lamps 38 into a plurality of independently controllable illumination zones, air flow through the apparatus can also be controlled through zones. For example, with reference to FIG. 1, the right side of the apparatus can be considered a separate zone such that blower 28 can be independently controlled to control the heat and force of air being admitted to plenum 22. Likewise blower 28' can be considered a controlling blower for plenum chamber 22' which can be considered a separate zone. Each of blowers 28" and 28'" supply air to plenum chamber 22" which could be considered a third zone. In addition to the zones shown, it will be appreciated by those skilled in the art that through the addition of independent and separately controlled blowers and duct work, additional zones could be supplied. For example, each of the side walls of the baffles could be independently arranged in four zones including a front lower quadrant, front upper quadrant, rear lower quadrant and rear upper quadrant. So segregated, the temperature and flow rate of air through the nozzles in each of the four quadrants could be separately controlled.

Control of the various lamp zones and air flow zones is preferably provided through an automotive controller such as a programmed microprocessor (not shown). The method of control and important parameters pertaining to control will now be described as part of the method of the invention.

B. Method of the Invention.

With an apparatus 10 as described, the method of the invention can be used to quickly heat treat an automotive coating applied to an automobile body to provide a high quality finish for Class A surfaces.

The apparatus can be used to dry, set or cure an automotive coating applied to an automobile body. While these terms are well known in the art of treating coatings applied to automobile bodies, definitions of these terms (as used herein and in any appended claims) will now be provided for clarity and specificity. The term "dry" means a coat has been heat treated to a point where it is suitable for application of the next coat in the coating process. With reference to the base or color coat, a color coat is said to be dry when the color coat is acceptable for application of the clear coat such that the quality of the clear coat will not be affected by further drying action of the color coat. For example, with water based color coats, "dry" is understood in the art to mean the almost complete absence of water from the color coat. If the water were not absent, the clear coat would be susceptible to cracking, bubbling or "popping" during treatment of the clear coat as water vapor of the color coat would attempt to pass through the clear coat.

In the art, "set" is used with reference to either the E-coat, base or color coat or clear coat. The term "set" means the automobile coat has been treated to a condition where the coating is tack-free and not disturbable by air currents. Fresh automobile coatings have an adherence to dust and other airborne contaminants. Even though air blown by blowers 28—28" is initially filtered so that it is of paint booth quality, small amounts of fine contaminants are still present. As well understood in the art, "tack-free" means the coating is treated to a point where there is no longer a strong adhesion between the coating and the dust such that dust will blow past the automobile surface without marring the coating. Also, automobile coatings are liquids applied to automobile surface. When the coating is fresh, the coating will form waves or ripples when contacted by air currents having a high air flow rate. A set coating can withstand high air flow rates without being marred by reason of air flow induced ripples.

The term "cure" is known in the art to refer to completion of the treatment process. As an example, the coating completes its chemical process and cross-links. While complete cross-linking may take substantial time, the art uses the term "curing" to mean that degree of cross-linking where the industry accepts the coating process as sufficiently complete to transfer the coated automobile body to a lot. It is the industry's use of the term "cured" which is used herein.

With primary reference to FIGS. 1 and 2, the automobile body 110 is placed within chamber 15 surrounded by the illuminated panels 36 and the various baffle walls 20 through 20''. Initially, the automobile body 110 is freshly coated with an E-coat As known in the art, fresh coats when wet are susceptible to being marred through dusts and other contaminants. Also, excessive air currents impinging upon freshly coated surfaces can cause the coating to flow along the surface such that when it dries it forms a ripple. After a coat has initially set, the coat (even though not yet cured) can withstand a high air flow rate without marring the surface. Accordingly, blowers 28 through 28''' are initially controlled to blow air into plenum chambers 22 through 22'' at a rate sufficiently low such that the velocity of air passing through nozzles 53 is below a rate which would mar the coating causing the fresh E-coat to flow on the surface of the automobile body. The flow of air into chambers 22 through 22'' is not completely eliminated however in order to provide a flow of air which will cool the lamp panels 36. As shown most clearly in FIGS. 3, 5, 7–9, air flow from the plenum passes through openings 40 and is directed toward the back side of the metallic reflectors. The air flows along the back surface of the metallic reflectors until it reaches the nozzles 53 and is directed into chamber 15. Also, air flows through the hollow mounts 58 and flows around the flattened down electrode portion 63 to cool the lamp 38 and electrode 63.

With the air flow cooling the lamps and electrodes, the lamp panels 36 are illuminated to generate infrared radiation to initially set the E-coat on the Class A surfaces of the automobile. Most non-Class A surfaces will not be set by the infrared radiation since they are shadowed and are heated solely through conduction through the automobile body and random scattering of the infrared radiation. However, the Class A surfaces are directly exposed to the lamp panels and receive the direct radiation.

With the intense heating of the lamps, the E-coat on the Class A surfaces is quickly set. Following this interval of time, the intensity of the lamps can be reduced or eliminated at which point heaters 32 through 32''' heat the air flow through ducts 30 through 30'''. Simultaneously, blowers 28 through 28''' are turned up to increase the rate of flow through the apparatus. Preferably, heaters 32 through 32''' are controlled such that the air passing through nozzles 53 have a temperature from 150° F. to 450° F. and exits the nozzles 53 at a velocity of approximately 3,000 feet per minute or such other predetermined high velocity to treat the coating. At these high velocities the air flow would be sufficient to mar and ripple an unset paint finish. This air flow is insufficiently high to mar the preset Class A surfaces. The air flow cures the Class A surfaces and provides convection heating into those areas which have been shadowed from the lamps in order to set as well as cure the non-Class A surfaces.

As shown in FIG. 1, the air flow follows a path from the blowers 28 through 28''' through heaters 32 through 32''' and into plenum chambers 22 through 22'. The air flow either passes through baffle passages 40 or through the subfloor area 17 into chamber 15. The blowers draw the air from chamber 15 through the ducts 34 into the inlets of the blowers. As a result, air flow is continuously recirculated in order to utilize the sensible heat of the air. Air flow may be bled off when contaminants such as vapors or water within the air attains a predetermined maximum and may be supplemented with fresh air to make up any losses. Preferably supplemented air will be of "paint booth" quality meaning it is highly filtered and low in particulates.

Figure 12:
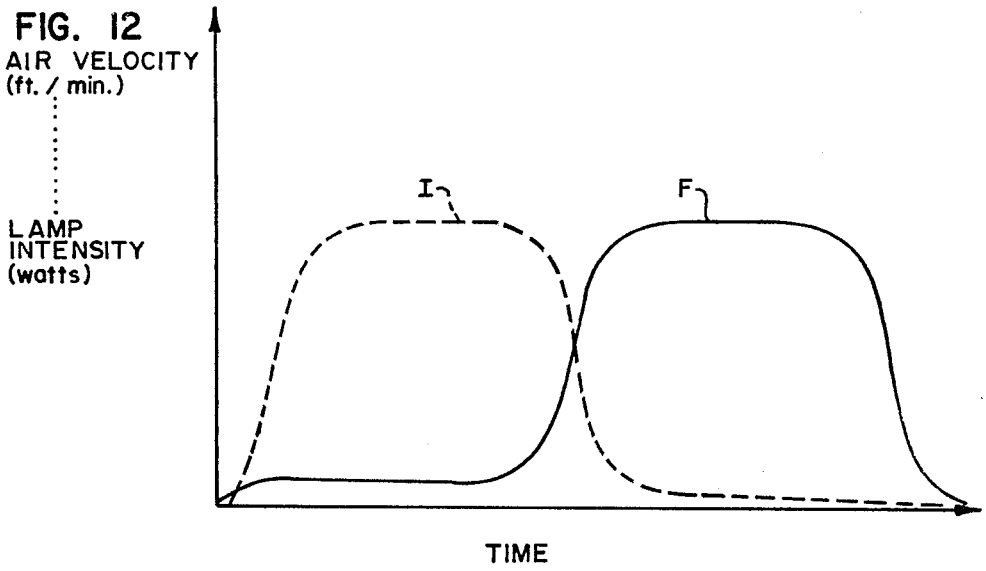
FIG. 12 is a graphical illustration showing operation of the treatment apparatus of FIG. 1.

FIG. 12 is a graphical illustration of the operation of the apparatus of FIG. 1. In FIG. 12, the abscissa represents time and the ordinate shows the values of air flow velocity (indicated by the solid line F of FIG. 12) and lamp intensity (indicated by the dotted line I of FIG. 12). As shown in FIG. 12, air flow is maintained at a low rate in order to cool the lamps until a predetermined time T at which the E-coat on Class A surfaces will be set. After this point in time, air flow is rapidly increased in order to provide sufficient convection to cure the Class A surfaces and set and cure the non-Class A surfaces. As also clearly shown in FIG. 12, the intensity of the lamps is initially set very high in order to set the Class A surfaces until a predetermined time T at which point the intensity of the lamps is reduced or eliminated with substantially all of the heating with in the oven being provided by the flow of hot air.

After the E-coat has been set and cured as described, the base or color coat is applied to the automobile body. With a fresh color coat applied, the automobile body 110 is placed within the apparatus 10 and, with air flow reduced to provide circulation and cooling of the lamps as described, the lamps are illuminated to set the color coat on the Class A surfaces in the same manner as the E-coat was set on the Class A surfaces. After the color coat has set, the lamp illumination is turned off and hot air flow at high velocity is introduced, as previously described, to dry the non-Class A surfaces. After all surfaces have been dried, a clear coat is applied to the automobile body. With the clear coat so applied, the freshly coated body 110 is placed within the apparatus 10 and, with air flow reduced to provide only circulation and cooling of the lamps, the lamps are illuminated to set the clear coat on the Class A surfaces through infrared radiation. After the clear coat on the Class A surfaces are set, the infrared radiation is reduced and hot high velocity air is admitted into the apparatus through the plenums to cure the Class A and non-Class A surfaces.

Depending upon the color of the coating, the style and configuration of the automobile body 110 and the positioning of the automobile body within the apparatus 10, the various zones of the lamps may be independently and proportionately controlled in order that the lamps furthest from a Class A surface can be illuminated at a greater intensity than lamps closest to a Class A surface. As a result, the Class A surfaces are uniformly heated by reason of the lamps generating uniform infrared radiation intensity on given surfaces. Lamp zones which do not oppose a Class A surface may be turned off to conserve energy. Knowing the configuration of the automobile body 110 as well as the particular parameters of the color of the coatings and the positioning of the body 110 within the apparatus 10, the microprocessor controller (not shown) can selectively control the various lamp zones to either turn off a zone which is not directly opposing a surface of the body 110 and to proportionately vary the illuminated zones so that intensity of infrared radiation on the surface of the body 110 is generally uniform throughout the body 110.

In order to minimize the distance from the lamps to the Class A surfaces, baffle walls 20 and lamp panels 36 may be moved toward or away from the automobile body as indicated by the phantom lines in FIG. 1. It will be well understood by those skilled in the art that the closer the lamp panels are to the Class A surfaces, the greater will be the percentage of available energy applied towards heating the body and treating the coatings on the body surfaces.

As a result of the method and apparatus of the present invention, an automobile body can be quickly cured in comparison to prior art processes and apparatus with the elimination of extremely long assembly line ovens. Further, the process of the present invention provides for a very high gloss high quality finish on Class A surfaces providing for a more desireable product.

C. Alternative Embodiments.

Figure 10:
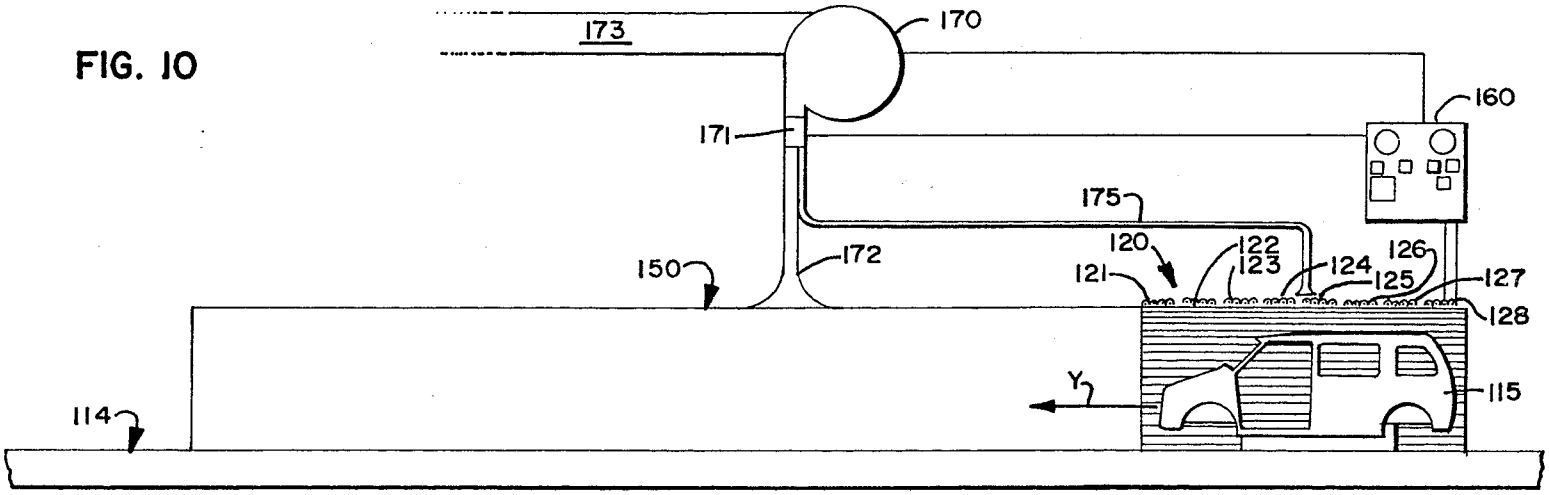
FIG. 10 is an elevation view of an assembly line according to an embodiment of the present invention for heat treating a coating applied to an automotive body.
Figure 11:
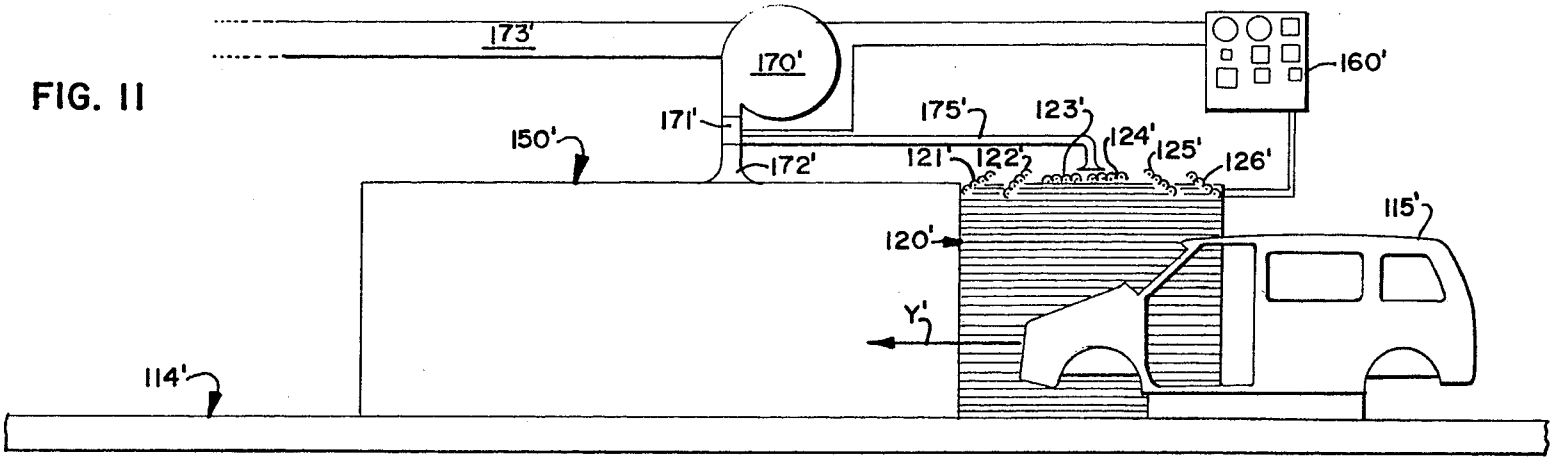
FIG. 11 is an alternative embodiment of the present invention for an assembly line for heat treating a coating applied to an automotive body.

Referring now to FIGS. 10 and 11, alternative embodiments of the present invention are shown. Unlike the preferred embodiment which utilized a batch oven, the embodiments of FIGS. 10 and 11 call for an assembly line embodiment for treating a coating on an automobile which is continuously being drawn along an assembly line. In FIG. 10, an infrared heating station 120 is shown in conjunction with a convection heating station 150. An assembly line 114 is provided for drawing an automobile 115 in the direction indicated by arrow Y such that the automobile body 115 first passes through infrared heating station 120 and then through convection heating station 150. As shown in FIG. 10, infrared heating station 120 includes a plurality of banks of infrared heating lamps including ceiling lamps 121, 122, 123, 124, 126, 127 and 128. Infrared heating station 120 has a longitudinal length greater than that of the auto body to be cured and, as previously described with reference to the embodiments of FIGS. 1 and 2, the infrared portion 120 is divided into a plurality of zones which are idependently controllable by a central control system 160 which may include microprocessors or the like.

As automobile 115 is dragged through the infrared portion 120 in the direction of arrow Y, the lamps which are opposing surfaces of the automobile body are illuminated with their intensity varying depending on the distance from the lamps to the auto body. For example, as the front of the vehicle enters the infrared heating area 120, lamp bank 128 will be illuminated at a high intensity to heat the forward portion of the car which is spaced a great distance from the lamps 128. At this point, lamps 121 through 127 will not be illuminated since they will not be providing significant contribution to setting the coating. As the auto progresses through the area 120, lamps 127 through 121 will, in turn, be illuminated. Further, as the roof portion of the vehicle passes the lamps, the lamps will decrease in intensity to account for the narrowing of the distance between the lamps and the surfaces to be set. The intensity of the lamps and the speed by which the vehicle body 115 is dragged through chamber 120 will be controlled such that when the vehicle 115 has passed out of chamber 120 into chamber 150, the coating on the Class A surfaces will be set. When the vehicle body 115 is within chamber 150, the controller 160 will operate a blower 170 having a heater 171 for blowing air from an inlet duct, through heater 171 with the heated air blown through duct 172 into chamber 150 in order to provide convection heating to cure or dry the coatings on the Class A surfaces and the non-Class A surfaces. A bleed-off conduit 175 is provided for drawing a portion of the heated air from blower 170 and directing the air against the lamps for cooling purposes.

A second assembly line alternative embodiment of the present invention is shown in FIG. 11 which includes an infrared heating chamber 120' as well as a convection heating chamber 150'. Chamber 120' is significantly shorter than the automobile body. Chamber 120' like chamber 120 has side walls with zone controlled banks of infrared heating elements Chamber 120' differs from chamber 120 in that the zones within the roof of the chamber 120 are directed in various directions other than the singularly downward direction of the zones of chamber 120. Notably, banks 121' through 126' are shown in the roof of infrared chamber 120'. As shown schematically in FIG. 11, banks 121' through 126' are oriented in different directions. Namely, the forward banks 121' and 122' are directed toward the rear of chamber 120' and centrally located banks 123' and 124' are directed downwardly. Lastly, rearward banks 125' and 126' are directed toward the forward end of the chamber 120'. As the vehicle 115 is directed in the direction of arrow Y', banks 121' and 122' will be first illuminated to direct radiant energy to set the forward portion of the vehicle. As the vehicle 115 is dragged through chamber 120', the remaining lights will be in turn illuminated until the vehicle is about the exit chamber 120' at which only lamps 125' and 126' will be illuminated. Similarly to the embodiment of FIG. 10, after the vehicle has completely exited chamber 120' and is disposed within chamber 150', blower 170' will blow air through heater 171' with the hot air directed through duct 172' into chamber 150' to completely cure or dry the Class A surfaces and to cure or dry the non-Class A surfaces through convection heating. A bleed duct 171' is provided for directing a portion of air from blower 170' to the lamp banks in order to cool the lamps as previously described.

Figure 13:
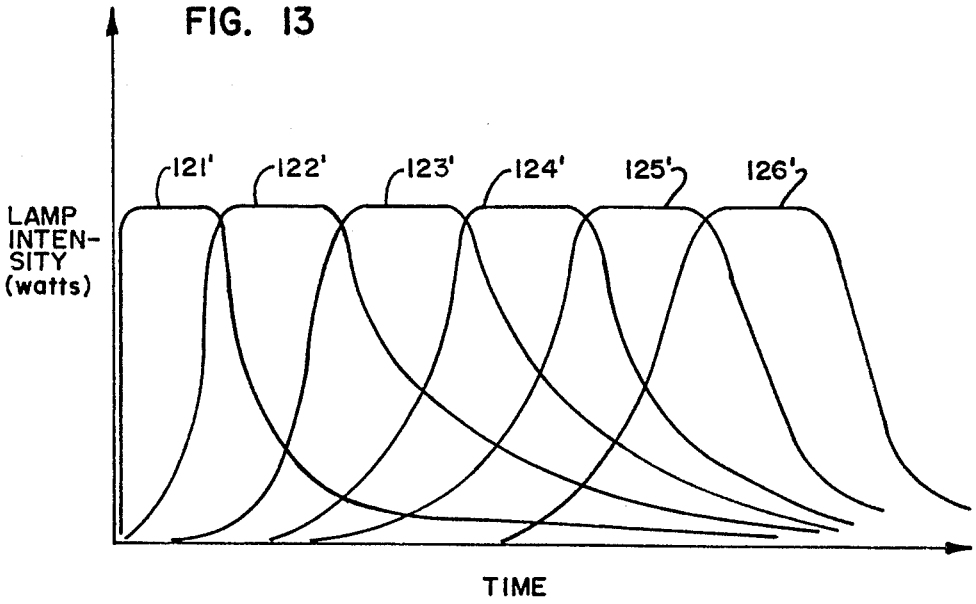
FIG. 13 is a graphical illustration showing operation of the apparatus of FIG. 11.

The operation of the infrared chamber 120' of the embodiment of FIG. 11 is graphically shown in FIG. 13 where the abscissa represents time and the ordinate represents lamp intensity on any suitable unit (e.g. watts). Lines 121' through 126' represent the illumination, over time, of ceiling banks 121' through 126'. As can be seen, the illumination of the lamps are progressively offset to set the Class A surfaces as the vehicle moves through chamber 120'.

With the apparatus of either FIG. 10 or 11, the complete cycle for coating an automobile body is as that described in reference to the apparatus shown in FIG. 1. Namely, the E-coat is applied to the automobile body.

As the automobile body is dragged through infrared heating stations 120, 120', the infrared radiation of the lamps sets the E-coat on the Class A surfaces. With the E-coat set, the body 115, 115' is passed into convection heating station 150, 150' where the Class A and non-Class A surfaces are cured by hot air circulation. Once the E-coat is cured on the Class A and non-Class A surfaces, the base or color coat is applied to the body 115, 115'. With a fresh color coat applied, the body 115, 115' is admitted into station 120, 120' where infrared radiation sets the color coat on the Class A surfaces. With the Class A surfaces set, the body 115, 115' is continuously dragged into station 150, 150' where hot air circulation dries the color coat on all surfaces as the body 115, 115' is continuously dragged through heating station 150, 150'. With the base coat so dried, a clear coat is applied to the automobile body 115, 115' which is then admitted to infrared heating stations 120, 120' where infrared radiation sets the clear coat on the Class A surfaces as the body 115, 115' is continuously moved through station 120. When the body 115, 115' passes from station 120, 120' into station 150, 150', the clear coat is set on the Class A surfaces and then, hot air circulation cures the clear coat on both the Class A and the non-Class A surfaces.

With the method and apparatus of the present invention, the necessary time needed to treat a coating applied to an automobile body can be drastically reduced. Additionally, and in assembly embodiments, the length of factory space which must be dedicated to treating the automobile body coating can be greatly reduced. For example, in setting the clear coat, it is anticipated that a typical automobile body must be subjected to infrared radiation for approximately 20 to 30 seconds. As a result, the time needed to set the coatings in Class A surfaces is greatly reduced thereby reducing the probability of contamination due to dust. To cure the clear coat, an additional 15 minutes of convection heating is anticipated. This is contrasted with prior art techniques where the total time from applying the clear coat until the clear coat was considered cured could last 43 minutes. Also, the present invention provides for an extremely high quality finish on the automobile. It will be appreciated that obtaining an improved quality finish in drastically reduced time are the primary goals of providing improvements in techniques and treatments for coatings applied to automobile bodies.

From the foregoing detailed description of the present invention, it has been shown how the objects of the invention have been attained in the preferred manner. However, modifications and equivalents of the disclosed concepts such as readily occur to those skilled in the art, are intended to be included in the scope of this invention. Thus, the scope of this invention is intended to be limited only by the scope of the claims as are, or may hereafter be, appended hereto.

What we claim is:

1. A process for finishing an automobile body with an E-coat, a base coat and a clear coat with apparatus having radiant heating means for generating infrared radiation and convection heating means for generating a flow of heated air, said radiant heating means including a plurality of zones with an intensity of at least a given zone separately controllable from an intensity of other zones, (a) applying an E-coat to said automotive body;
(b) setting said E-coat with said infrared radiation while separately controlling at least said given zone in response to a predetermined characteristic of said body within said given zone;
(c) curing said E-coat with said heated air;
(d) applying a base coat to said automotive body;
(e) setting said base coat with said infrared radiation while separately controlling said given zone in response to a predetermined characteristic of said body within said given zone;
(f) drying said base coat with said heated air;
(g) applying a clear coat to said automotive body;
(h) setting said clear coat with said infrared radiation while separately controlling said given zone in response to a predetermined characteristic of said body within said given zone;
(i) curing said clear coat with said heated air.

2. A process according to claim 1 wherein said E-coat is cured with said hot air after said E-coat has been set on Class A surfaces of said automotive body by said infrared radiation.

3. A process according to claim 1 wherein said base coat is dried by said heated air after said base coat has been set on Class A surfaces of said automotive body with said infrared radiation.

4. A process according to claim 1 wherein said clear coat is cured by said heated air after said clear coat has been set on Class A surfaces of said automotive body by said infrared radiation.

5. A process according to claim 1 wherein said characteristic includes at least a color of said body.

6. A process according to claim 1 wherein said characteristic includes at least surface contours of said body.

7. A process according to claim 1 wherein said characteristic includes at least a positioning of said body within said given zone.

* * * * *